United States Patent [19]

Brignola

[11] 4,296,786

[45] Oct. 27, 1981

[54] TRANSFER DEVICE FOR USE IN MIXING A PRIMARY SOLUTION AND A SECONDARY OR ADDITIVE SUBSTANCE

[75] Inventor: Dominic J. Brignola, Phoenixville, Pa.

[73] Assignee: The West Company, Phoenixville, Pa.

[21] Appl. No.: 79,867

[22] Filed: Sep. 28, 1979

Related U.S. Application Data

[63] Continuation of Ser. No. 661,869, Feb. 27, 1967, abandoned, which is a continuation-in-part of Ser. No. 333,650, Feb. 20, 1973, abandoned.

[51] Int. Cl.[3] ..... B65B 3/06

[52] U.S. Cl. ..... 141/309; 141/329; 222/83.5; 128/272.1; 128/272.3; 206/365

[58] Field of Search ..... 222/81, 83, 83.5, 85–86; 141/19, 329–330, 309, 319; 137/575; 206/365; 128/272.1, 272.3, 214.2, 221; 215/320, DIG. 3

[56] References Cited

U.S. PATENT DOCUMENTS

| | | | |
|---|---|---|---|
| 2,168,734 | 8/1938 | Freeman | 215/320 X |
| 2,677,373 | 5/1954 | Barradas | 206/365 X |
| 2,814,296 | 11/1957 | Everett | 128/221 X |
| 2,825,334 | 3/1958 | Kas, Sr. | 222/85 X |
| 3,021,942 | 2/1962 | Hamilton | 206/365 |
| 3,033,202 | 5/1962 | Richter et al. | 141/329 X |
| 3,245,567 | 4/1966 | Knight | 128/221 |
| 3,316,908 | 5/1967 | Burke | 222/81 X |
| 3,336,924 | 8/1967 | Sarnoff et al. | 206/365 X |
| 3,368,557 | 2/1968 | Hassing et al. | 128/221 |
| 3,545,607 | 12/1970 | Keller | 206/365 |
| 3,833,248 | 9/1974 | Wossner et al. | 293/86 |
| 3,938,520 | 2/1976 | Scislowicz et al. | 222/83 X |
| 3,995,630 | 12/1976 | van de Veerdonk | 128/272.1 X |
| 4,011,288 | 3/1977 | Assenheimer et al. | 222/86 X |

FOREIGN PATENT DOCUMENTS

| | | | |
|---|---|---|---|
| 686219 | 5/1964 | Canada | 128/272 |
| 1810299 | 6/1970 | Fed. Rep. of Germany | 222/566 |
| 799455 | 4/1936 | France | 128/221 |
| 1122616 | 5/1956 | France | 128/272.3 |
| 1416483 | 9/1965 | France | 222/83 |

*Primary Examiner*—Charles A. Marmor
*Attorney, Agent, or Firm*—Eugene E. Renz, Jr.

[57] ABSTRACT

A transfer device for use in mixing substances in different containers normally closed by a stopper of resilient material having a puncturable diaphragm consisting of a central body portion and a pair of aligned spikes or cannulas projecting from opposite sides of said central body portion. Each of the cannulas terminates in a tip portion remote from the central body portion and there are at least one pair of transfer passages extending through the cannulas, the opening at one tip portion of one of the transfer passages is of smaller cross section than the opening of said transfer passage at the tip of the other cannula. The other transfer passage is the reverse of the first transfer passage; that is, the cross sectional relationships of the openings at the tips are the opposite of the first transfer passage. Thus in use the cannulas are inserted through the stopper in a pair of containers to transfer contents, usually fluid, from one container to the other, and the specific arrangement of the transfer passages facilitates smooth flow through the transfer device, one being a fluid passage, the other an air venting passage. The invention also includes the combination of a transfer device, an outer cover member including means for supporting the transfer device therein and a detachable closure member overlying and normally sealing the opening in the outer cover member.

32 Claims, 32 Drawing Figures

FIG. 5a.
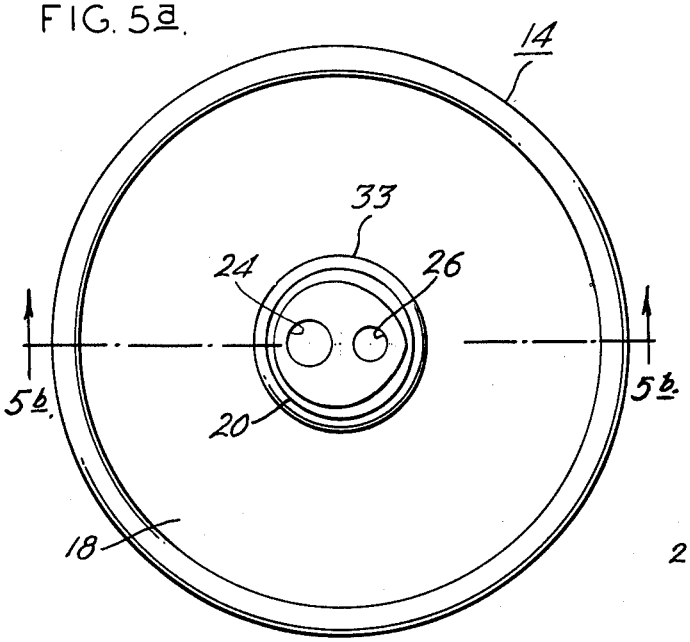
FIG. 5b.
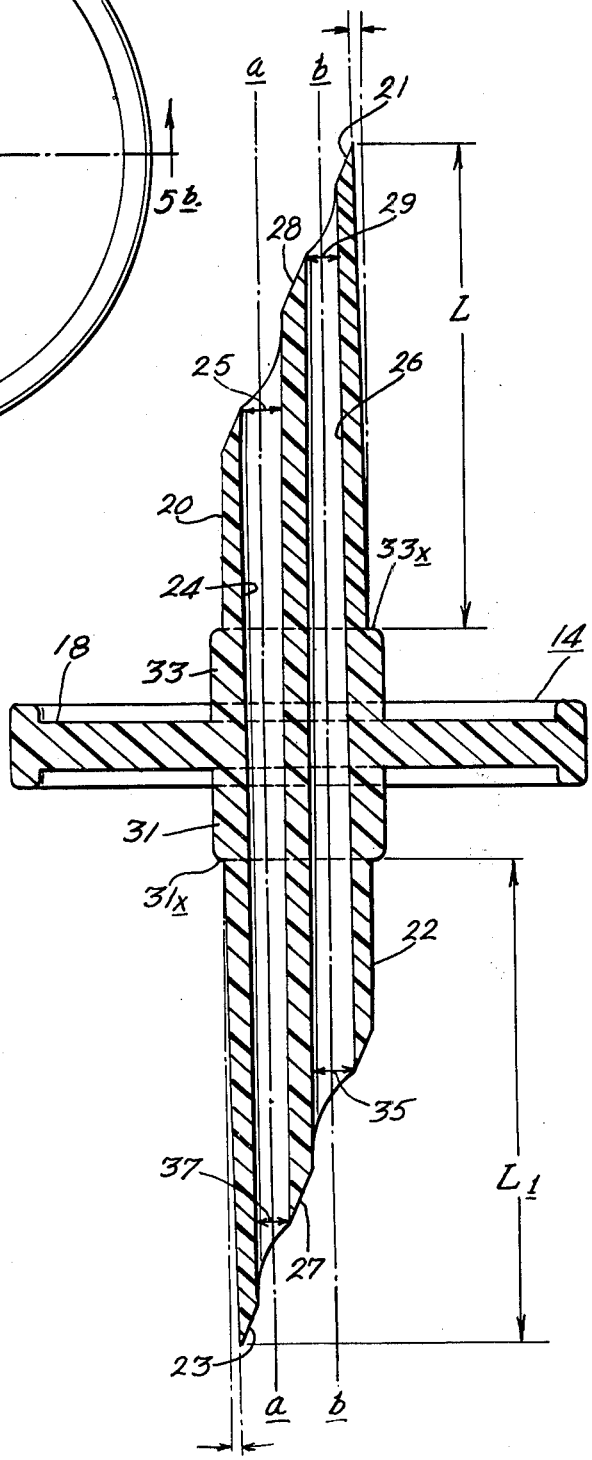
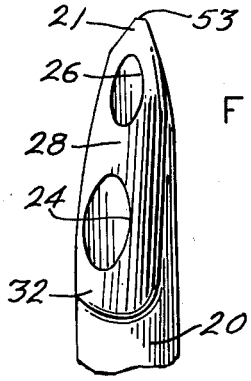
FIG. 5d.
FIG. 5c.
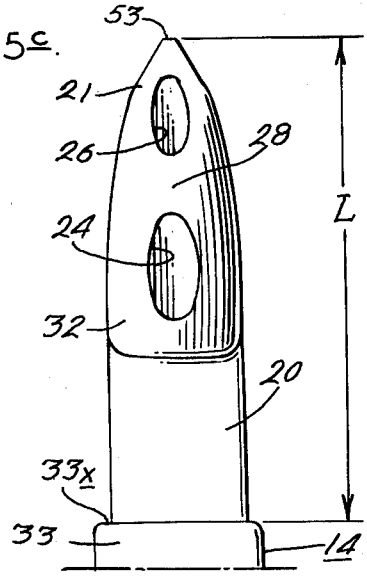

TRANSFER DEVICE FOR USE IN MIXING A PRIMARY SOLUTION AND A SECONDARY OR ADDITIVE SUBSTANCE

This application is a continuation of my prior application Ser. No. 661,869, entitled "Transfer Device For Use In Mixing A Primary Solution And A Secondary Or Additive Substance" filed Feb. 27, 1967, now abandoned, which in turn is a continuation-in-part of my earlier application, Ser. No. 333,650, entitled "Transfer Device For Use In Mixing A Primary Solution And A Second Or Additive Substance" filed Feb. 20, 1973 now abandoned.

This invention relates to a system for the preparation of solutions and more particularly relates to the preparation of solutions for parenteral administration.

More specifically, the present invention relates to preparing solutions for injection intravenously wherein the solutions comprise a primary or stock solution such as distilled water, normal saline solution, or glucose solution, and a secondary or additive substance for mixing in predetermined quantities with the primary solution, for example, various salts, amino acids, antibiotics and the like. Previously it has been the practice to prepare the primary solution and a predetermined concentration of a given additive in a laboratory under sterile conditions and then supply the same to the hospital in a completely prepared solution for injection. This method is extremely impractical since it requires a large stock of premixed solutions of all the substances which may be desired for injection. Additionally, this method is unsuitable for solutions which contain an active ingredient which is not sufficiently stable on storage in dissolved form.

With the foregoing in mind, an object of the present invention is to provide a system wherein predetermined measured quantities of a secondary additive may be transferred under sterile conditions to a primary or stock solution by hospital personnel when needed. To this end, the present invention provides an additive assembly consisting of an outer housing member within which is supported a transfer device having a control body portion and a pair of spikes or cannulas projecting from the body portion with air and liquid flow passage channels therein and a tear seal removable by the user to expose an opening in the outer housing whereby one cannula of the transfer device may be inserted through the stopper in the additive container without being touched by the hands of the user. The cover assembly is then removed so that the other cannula may be inserted into the stopper of the primary solution to effect transfer of the additive to the primary solution and mixture therewith. It is noted that either the container for the primary solution or the container for the additive can be employed as the container for mixing the primary and additive solution. Additionally, it is noted that the additive may be a powder medicament. The housing is designed so that it normally retains the transfer device in a predetermined position to be applied to the additive container and also serves a secondary function of being a dust cover for the container of the mixed solution. The cover also serves as indicia means that the additive has been mixed with the primary or stock solution. The present invention therefore provides a relatively economical means for transferring additive to a primary or stock solution under sterile conditions where the additive and primary are transferred without contacting the air.

These and other objects of the present invention and the various features and details of the operation and construction thereof are hereinafter more fully set forth with reference to the accompanying drawings wherein.

FIG. 5*a* is a plan view of the transfer device;

FIG. 5*b* is a sectional view taken on line 5*b*—5*b* of FIG. 5*b;*

Figure 6:
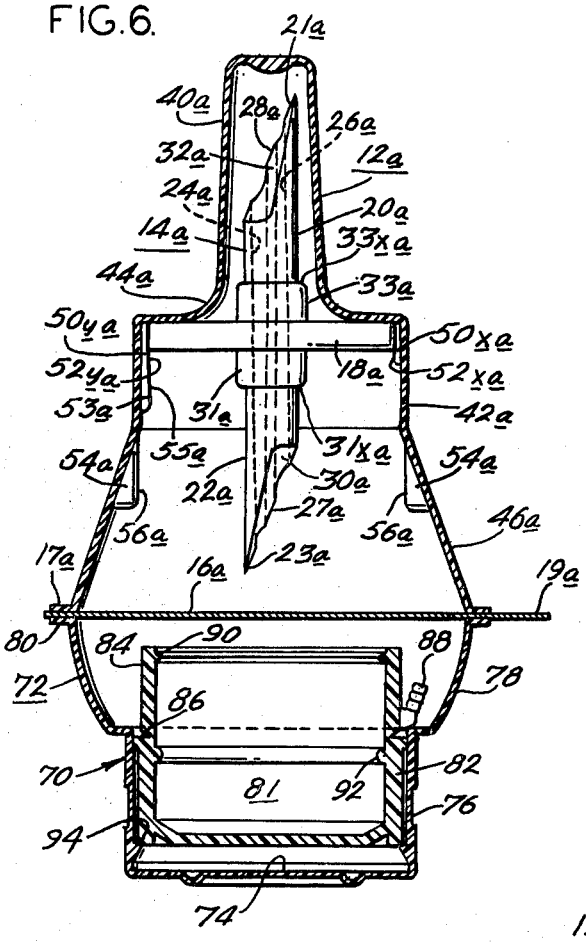
Figure 7:
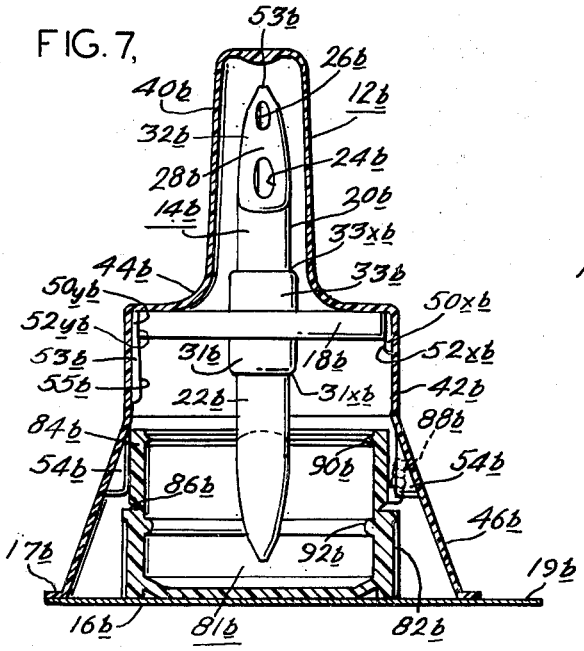
Figure 8:
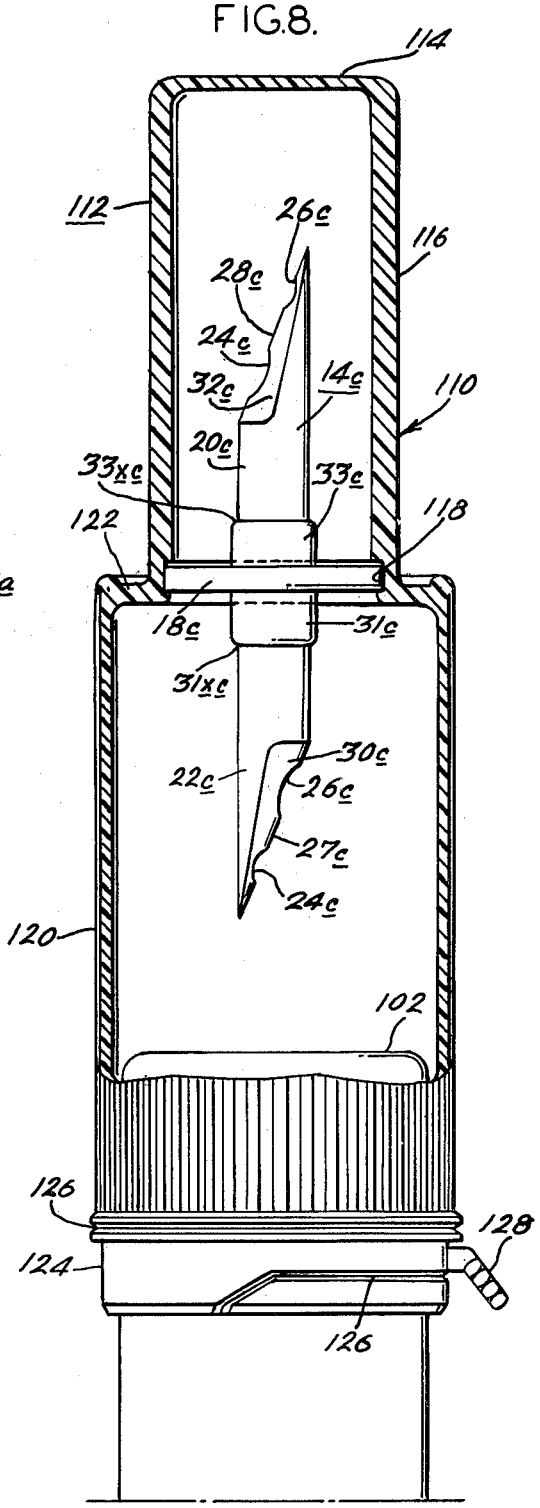
Figure 9:
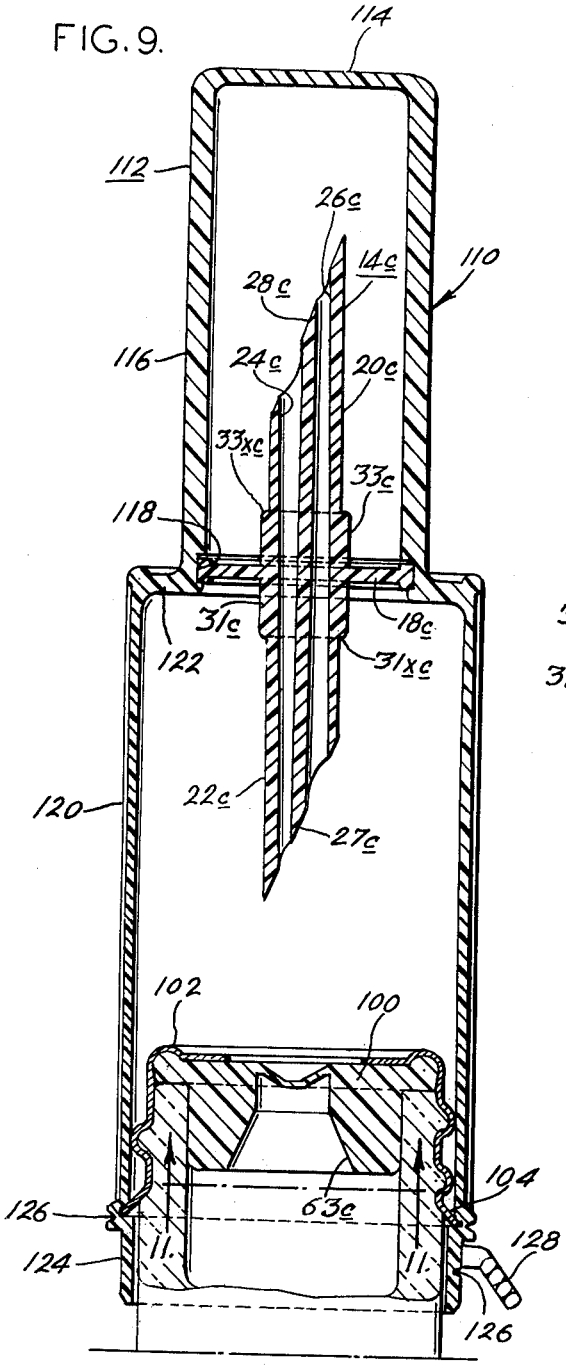
Figure 10:
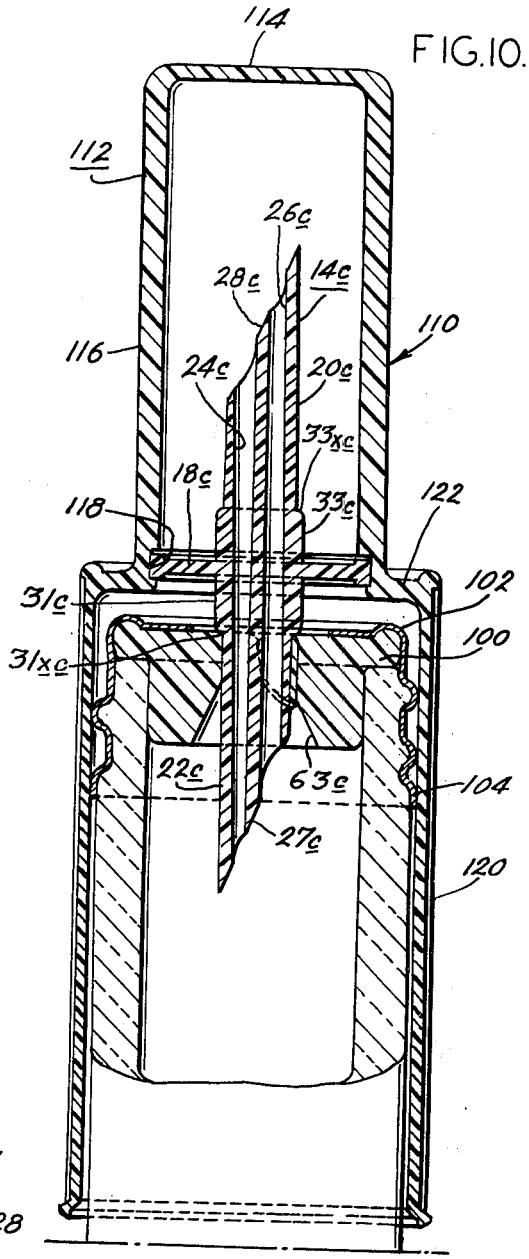
Figure 11:
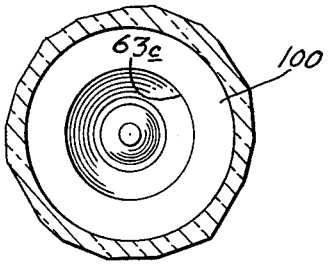
Figure 12:
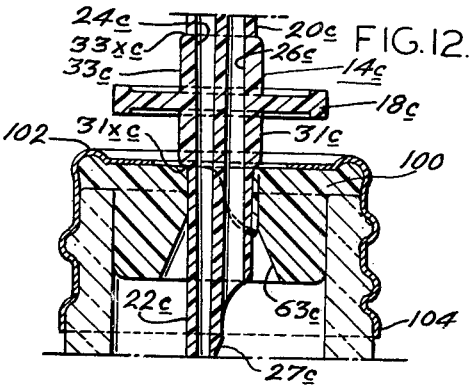
Figure 13:
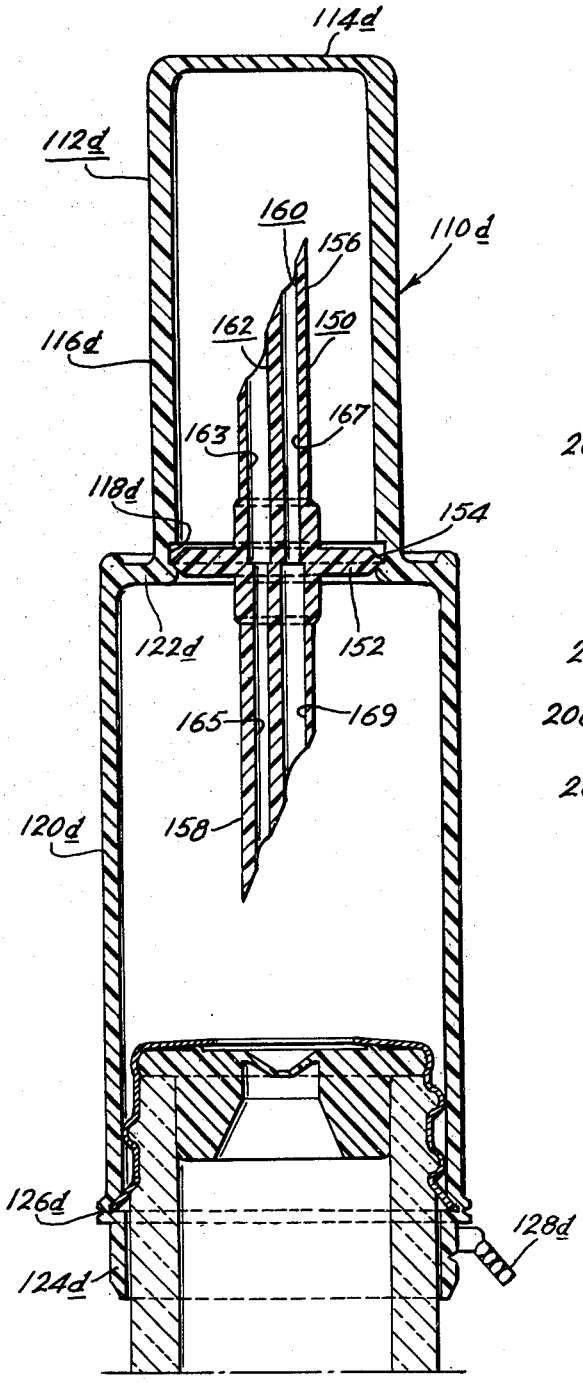
Figure 14:
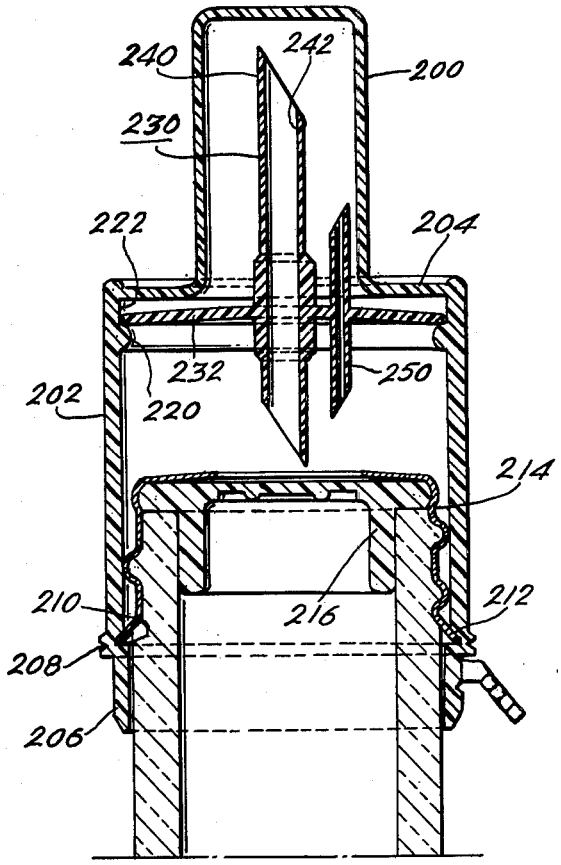
Figure 15:
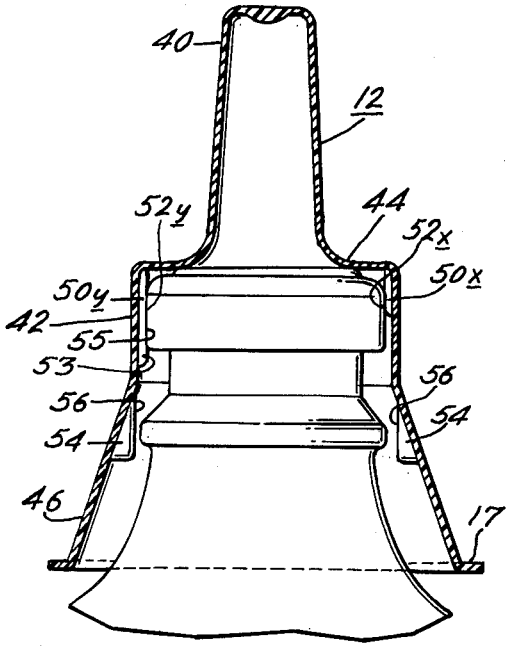
Figure 17:
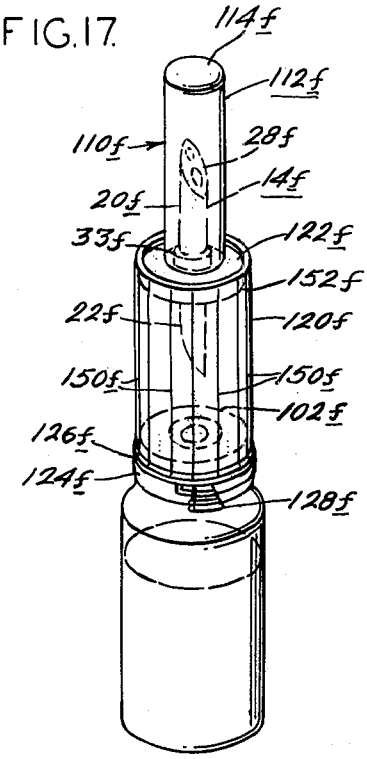
Figure 16:
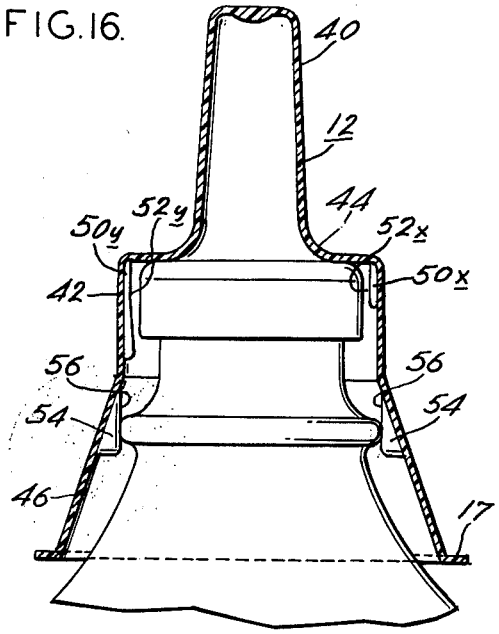
Figure 18:
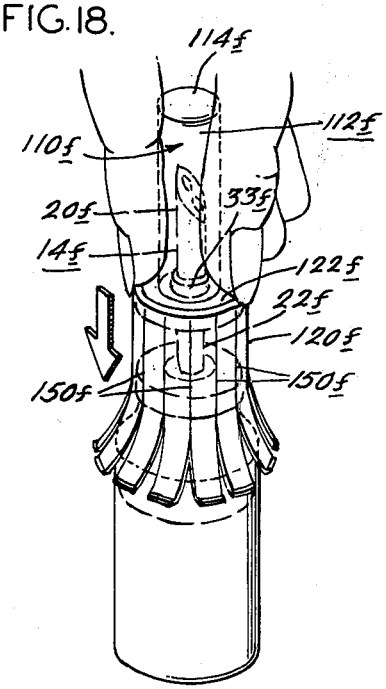

FIG. 5*c* is an enlarged side elevational view of one of the spikes of the transfer device;

FIG. 5*d* is a perspective view of one of the piercing tips of the transfer device;

FIG. 6 is a transverse sectional view of another embodiment of additive transfer assembly in accordance with the present invention;

FIG. 7 is a view similar to FIG. 6 os still another embodiment of additive transfer assembly in accordance with the present invention;

FIG. 8 is a side elevational view partly in section of a further embodiment of additive transfer assembly in accordance with the present invention;

FIG. 9 is a side elevational view partly in section of the assembly of FIG. 8 as applied to a container for an additive;

FIG. 10 is a view similarr to FIG. 9 showing the transfer device engaged in the stopper of the container in position to transfer the contents thereof to another container;

FIG. 11 is a sectional view taken on line 11—11 of FIG. 9;

FIG. 12 is a view similar to FIG. 10 with the outer cover or housing removed;

FIGS. 13 and 14 are still further embodiments of I.V. additive assemblies in accordance with the present invention;

FIG. 15 is a side elevational view with the outer cover or housing applied to a container;

FIG. 16 is a view similar to FIG. 15 showing the outer cover or housing of an additive transfer assembly applied to a slightly different type of container;

FIG. 17 is a perspective view of still a further embodiment of transfer additive assembly in accordance with the present invention; and FIG. 18 is a view showing the transfer device being applied to a container.

Figure 19A:
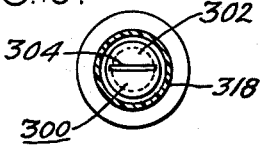
Figure 19:
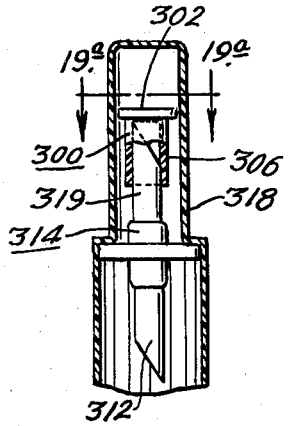
Figure 20:
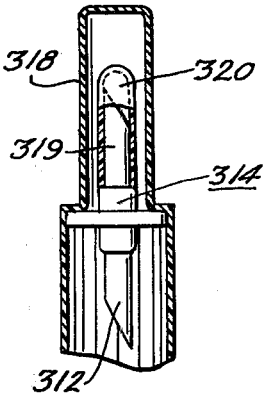
Figure 21:
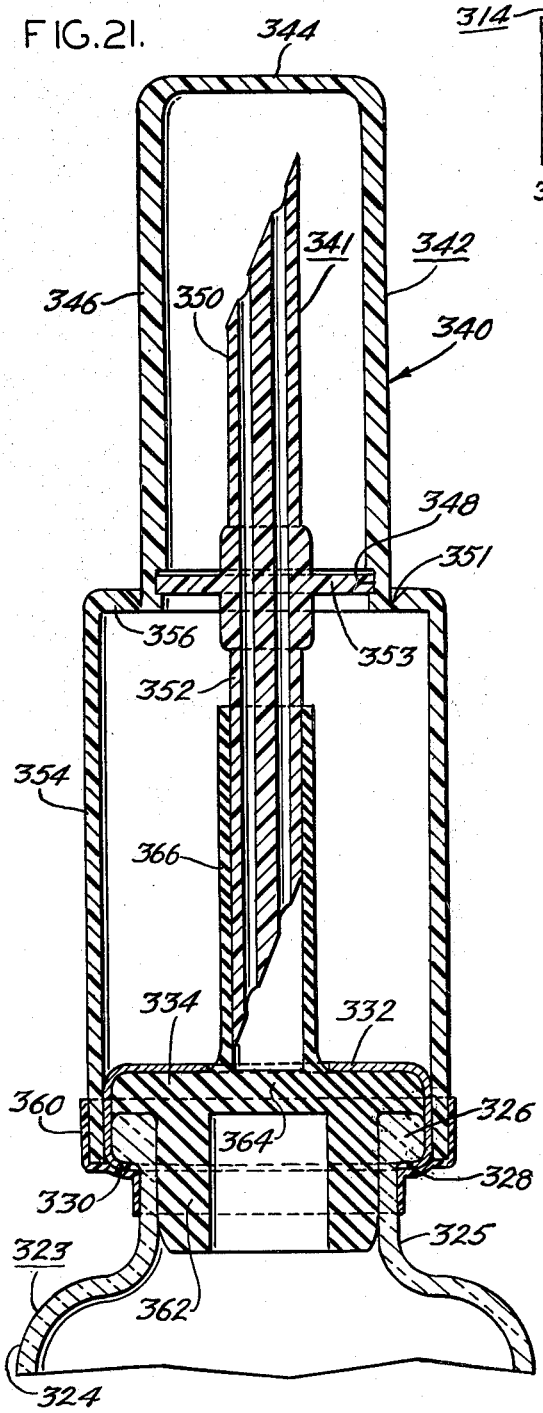
Figure 22:
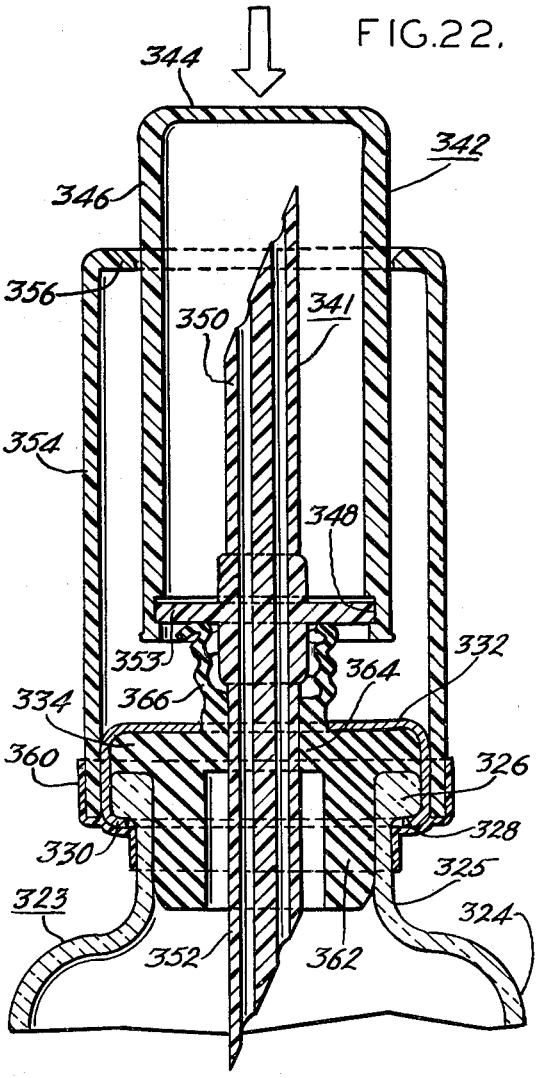
Figure 23:
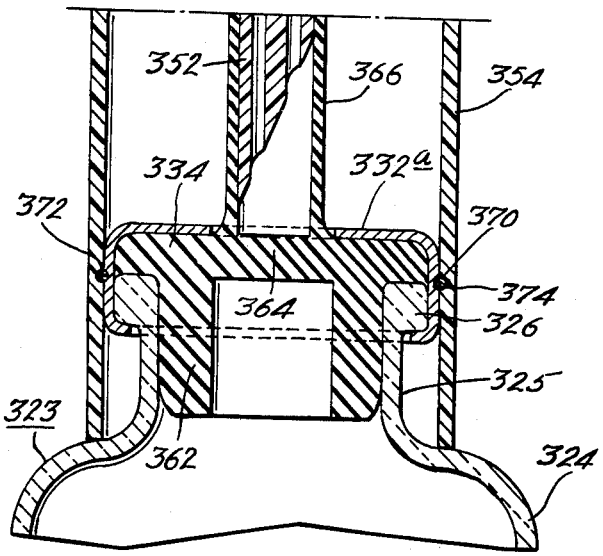
Figure 24:
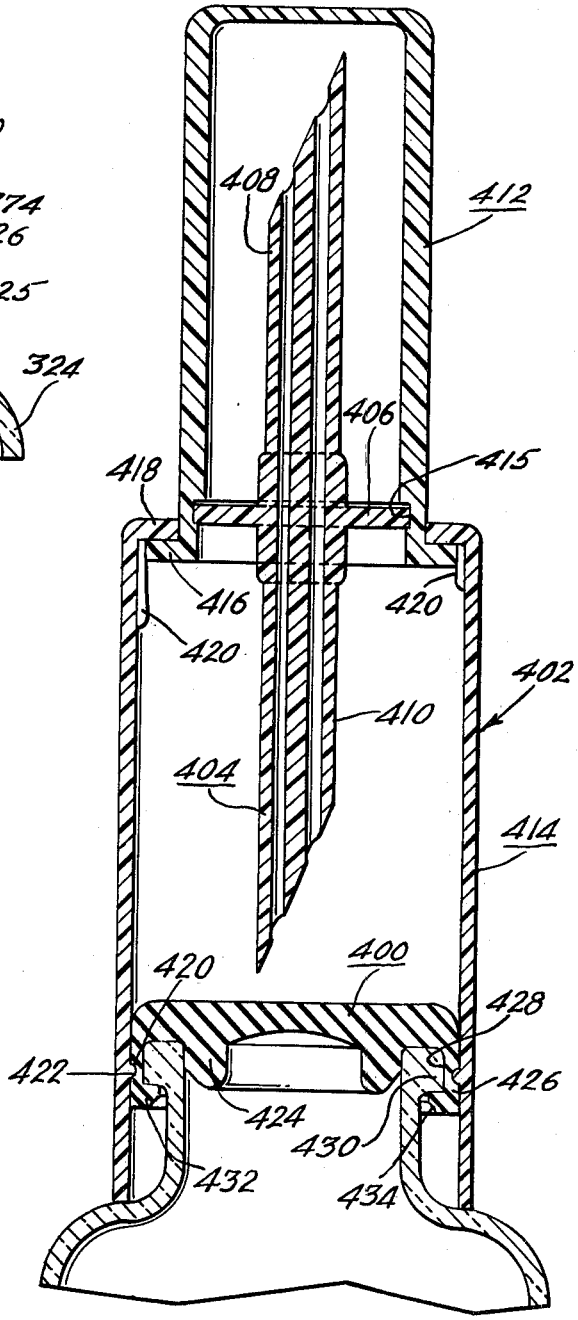
Figure 19B:
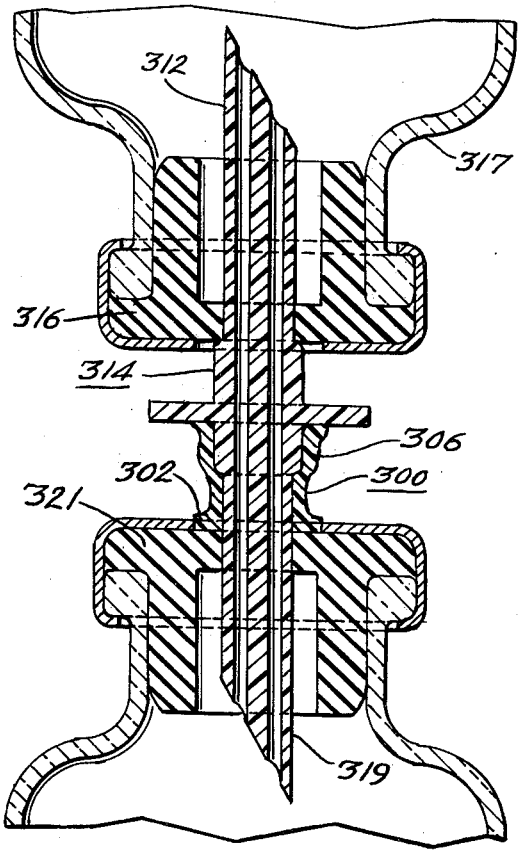
Figure 26:
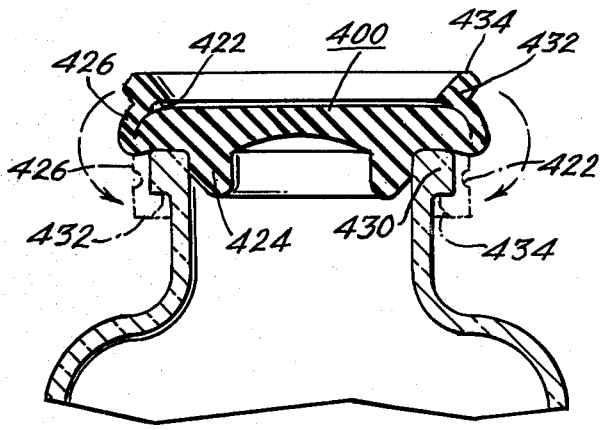
Figure 25:
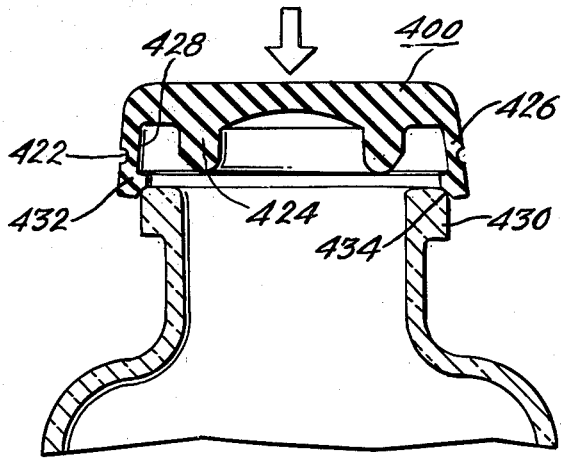

FIG. 19 is a fragmentary transverse sectional view of a transfer device and outer cover assembly generally similar to that shown in, for example, FIGS. 10 and 13 illustrating a pierceable cap for one cannula of the transfer device;

FIG. 19*a* is a view taken on lines 19*a*—19*a* of FIG. 19 showing the top of the cap;

FIG. 19*b* is a view showing the transfer device in an armed transfer position;

FIG. 20 is a view similar to FIG. 19 showing a modified form of pierceable cap for the cannula;

FIG. 21 is a modified form of outer cover assembly for a transfer device adapted for use on containers having an enlarged body portion;

FIG. 22 is a sectional view of the assembly of FIG. 21 in the actuated or armed position;

FIG. 23 is a fragmentary transverse sectional view of an assembly similar to FIG. 22 except with a different form of sealing means with the container;

FIG. 24 is a sectional view of still another additive transfer assembly in accordance with the present invention; and FIGS. 25 and 26 are views illustrating the stopper of the assembly of FIG. 24 in a partially assembled position.

Referring now to the drawings and particularly to FIGS. 1–5 inclusive thereof, there is illustrated an additive transfer assembly in accordance with the present invention generally designated by the numeral 10. The assembly includes an outer cover member or housing 12 and a transfer device generally designated by the numeral 14. The outer cover member 12 is open at its lower end and mounts a detachable closure disc 16 which is heat sealed at its outer periphery to the flange 17 at the lower edge of the cover assembly 12. The closure disc 16 is preferably made of a gas permeable material to facilitate permanent sterilization of the transfer device after assembly in the outer cover member.

Figure 1:
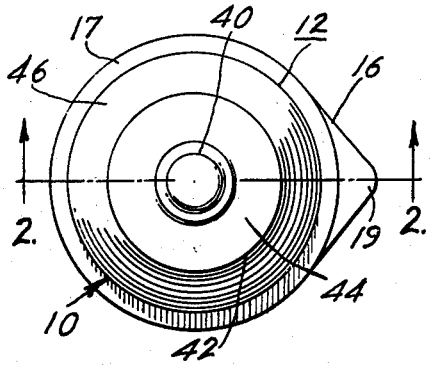
FIG. 1 is a plan view of an additive transfer assembly constructed in accordance with the present invention.
Figure 2:
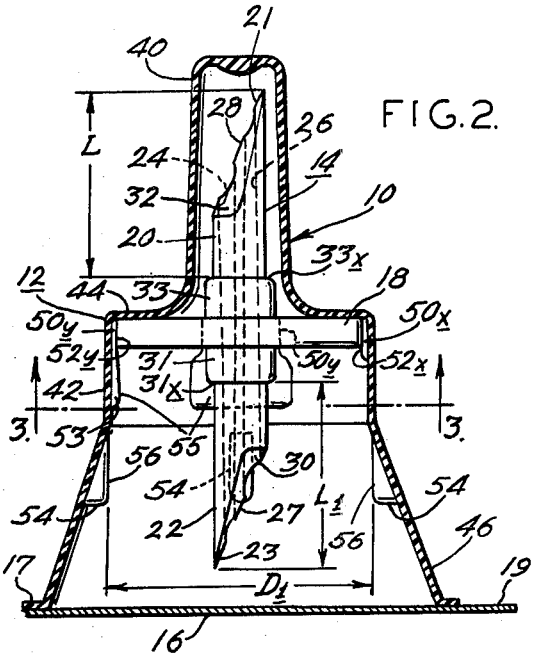
FIG. 2 is an enlarged sectional view taken on lines 2—2 of FIG. 1.
Figure 3:
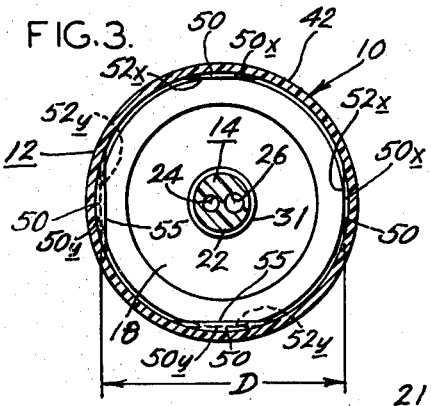
FIG. 3 is a sectional view taken on line 3—3 of FIG. 2.
Figure 4:
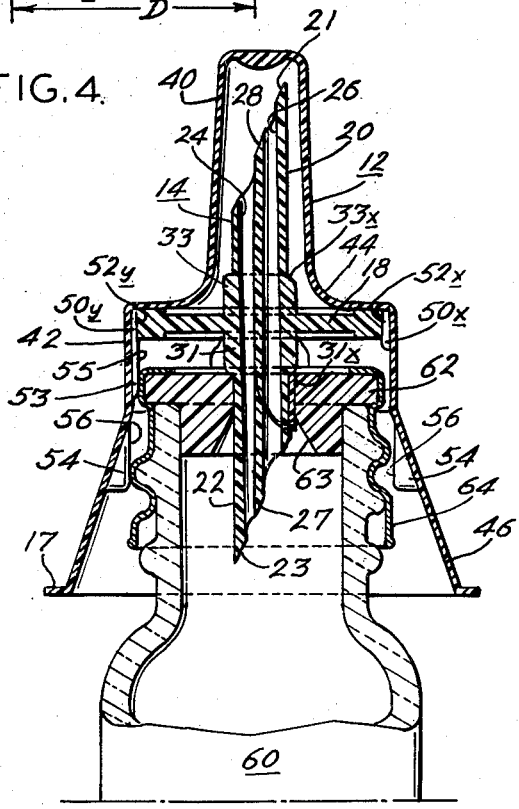
FIG. 4 is a side elevational view partly in section showing the transfer device applied to a container.

The transfer device 14 as illustrated has a central disc portion 18 and an elongated cannula or spike 20 and 22 projecting from opposite sides of the disc portion 18 and disposed centrally thereof. The spikes 20 and 22 are aligned and formed integrally with the disc 18 of a suitable plastic material and are provided with a pair of axially extending transfer passages 24 and 26 respectively to permit fluid flow from one container to another in a manner described in more detail hereinafter. As illustrated, the cannulas 20 and 22 terminate at their outer terminal ends in tip portions 21 and 23, respectively, which are of a configuration to facilitate penetration through the stopper. In the illustrated embodiment, the transfer passage 24 is of a greater cross sectional area at the tip 21 as at 25 than the cross sectional area of the transfer passage 26 at the tip 21 as at 29. At the tip 23 of the cannula 22, the transfer passage 26 is of a greater cross sectional area as at 35 then the cross sectional area of the transfer passage 24 of the tip 23 as at 37. In the present instance, this is accomplished by tapering each of the transfer passages relative to a central axis. For example, the transfer passage 24 which is of circular cross section is tapered relative to its central axis a-a and converges downwardly toward the tip 23, whereas the transfer passage 26 which is also of circular cross section converges and tapers upwardly toward the tip 21 with respect to its central axis b-b. By this arrangement, when the transfer device is inserted into the stopper of the container as illustrated in FIG. 4 to transfer the contents thereof, fluid will flow through the transfer passage having the larger opening at the tip to insure complete transfer of the contents, and the passage 24, since it depends deeper into the container, will serve as the air venting passage. In other words, by this construction the long leg of each of the cannulas terminates at its tip in a small opening and the short leg terminates in a larger opening. This facilitates proper flow of fluid through the transfer device and insures that the maximum amount of the contents of the containers are discharged through the transfer device.

Figure 5:
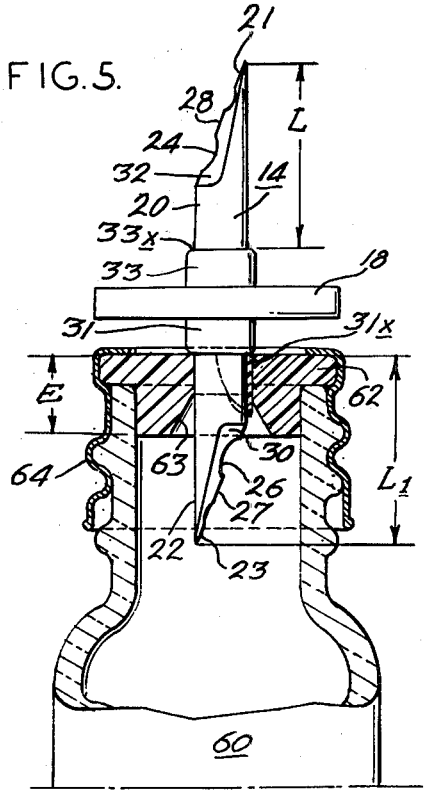
FIG. 5 is a view similar to FIG. 4 showing the outer housing removed from the transfer device.

The outer terminal end of each cannula is tapered in relation to the central axis as at 27 and 28, the tapers being diametrically opposed and generally parallel to one another. The angle of taper is preferably in the range between 45°–60°. The face of the tapered tip of each of the spikes is also rounded as at 30 and 32 and is preferably coated with a lubricant so that it may penetrate the rubber stopper easily in a manner to prevent particulation and "coring". The terminal openings of the transfer passages are located in a common plane in the tip of each cannula and are relatively closely spaced. In the present instance, the openings are located on the surface of revolution defined by the contoured faces 30 and 32. The contoured piercing faces 30 and 32 function in a manner to displace the rubber of the stopper as the spike is inserted to penetrate the stopper, whereby the force to insert the stopper is substantially uniform so that there is no surging which could produce a larger opening resulting in leakage, or no penetration of the stopper at all. As illustrated in FIG. 5*c*, the outer terminal portion of each of the tips 21 and 23 are preferably tapered to define an included angle of about 30 and the terminal end is a blunt but sharp point as at 53. The spikes 20 and 22 are enlarged as at 31 and 33 at the juncture of the central disc portion 18 to provide an abutment shoulder 31*x* and 33*x* to limit insertion of the spikes in a stopper as illustrated, for example, in FIGS. 4 and 5. By this arrangement, when a spike of the transfer device 14 is inserted in a container, the spike penetration is limited by the abutment shoulder thereby spacing the central disc portion from the top of the stopper, and thus minimizing the chance of contamination of the stopper when the transfer device is removed by the user. The outer periphery of each of the spikes 20 and 22 taper slightly toward the tip from the shoulder 31*x* and 33*x*, respectively, at about a taper of 2° as illustrated in FIG. 5*b*.

In the illustrated embodiment, the outer cover member 12 as illustrated has an elongated dome section 40 of a depth to house the upper cannula 20 so that the top of the dome is spaced from the tip of the cannula, a generally cylindrical skirt portion 42 merging with the dome section in an annular radial wall 44 and an outwardly flared frusto-conical lower terminal section 46 which terminates in a radially outwardly directed flange or lip 17 against which the cover seal 16 is sealed. The cover seal 16 has a tab 19 to facilitate gripping and removal of the seal by the user. The depth of the skirt 42 and lower terminal section 46 are suitably dimensioned so that the tip of the lower cannula 22 is spaced from the cover seal 16 in the assembled relation. Even though the skirt 42 is illustrated as being frusto-conical, it could be made of other shapes, for example, cylindrical. The dome section 40 provides a suitable and convenient gripping means for the user when it is desired to remove the cover assembly, and the radial wall 44 adjacent the lower end of the dome prevents the spike from puncturing the top of the dome and possibly injuring the hand of the user.

The transfer device 14, in the present instance, is supported in the outer cover or housing 12 by means of four circumferentially equi-spaced lugs 50 formed on the interior wall of the skirt 42. In the present instance, two of the adjacent lugs 50*x* spaced 90° apart have an inner face 52*x* generally tangent to the circular trace of the central disc portion 18 of the transfer device and extend downwardly in an axial direction a distance slightly greater than the thickness of the central disc portion. The other two lugs 50*y* have inner face portions 52*y* confronting the inner face portions 52*x* which are also tangent to the circular trace of the central disc portion 18 and also have a depending portion 53 having an inner face 55 which tapers inwardly at a slight angle of about 2° relative to the face portion 52*y*. These lugs serve to hold the transfer device firmly in place during handling, such as in shipment, and yet release the transfer device when it is inserted into the stopper of a container. The spacing D between the faces 52 of diametrically opposed lugs 50 at their upper edges is preferably less than the diameter of the central disc portion 18 of the transfer device to provide a friction fit therebetween and retain the transfer device in the housing in the manner illustrated in FIG. 3 prior to use. The friction fit is such, however, that upon application of the transfer device to a container as shown in FIG. 4, the cover will readily release itself when it is pulled in an upward direction axially relative to the transfer device. The transfer device may be assembled in the outer cover member, and thereafter the gas permeable closure disc applied. The assembled unit is then sterilized by conventional means and is ready for use. The transfer device is firmly supported in place so that the tip is out of engagement with the dome and disc, thereby insuring a particle-free atmosphere in the cover member prior to use.

The transfer device may be assembled in the outer cover member, and thereafter the gas permeable closure disc applied. The assembled unit is then sterilized by conventional means and is ready for use. The transfer device is firmly supported in place so that the tip is out of engagement with the dome and closure disc 16, thereby insuring a particle-free atmosphere in the cover member prior to use.

Considering now the use of the transfer additive assembly described above, the transfer device is used for transferring various types of additives to a primary or stock intravenous solution. These additives are usually packaged in containers 60 having a stopper 62 made of an elastomeric material supported in the opening in the container by a cap 64 usually having a detachable central disc portion which is not shown. When the user desires to mix the additive to another medicament, the removable disc is removed from the cap 64 to expose the diaphragm portion of the stopper 62. The user now simply removes the cover seal 16 by gripping the tab 19 and inserts the one spike into the diaphragm portion of the stopper to pierce the same as shown in FIG. 4. It is noted that the shoulder on the spike limits the distance it can be inserted and provides a seal minimizing the chance of leakage. The user now simply removes the outer cover member, to expose the other spike and inserts it into a stopper of a container of a stock solution to which the additive is to be mixed, thereby establishing fluid communication between the containers through the transfer device. The user then inverts the containers to permit flow of additive to the container having the primary solution. Each of the spikes 20 and 22 of the transfer device 14 is of a predetermined length L and $L_1$, respectively, between the shoulder 31*x* and 33*x* to its outer tip in relation to the axial depth E of the stopper so that the short leg of the transfer passage lies approximately in the plane of the lower face of the stopper. Additionally, note that the stopper has an outwardly flared portion 63 depending from its central opening which is normally closed by the diaphragm to provide a funnel insuring transfer of the maximum amount of the contents of the container through the transfer device. The transfer device is equally as effective for use in containers where the stopper is a disc-like element and does not have a clearly defined diaphragm where the spike displaces the rubber downwardly without coring.

It is noted that in this manner the transfer device is not contacted by the hands of the user and remains in a sterile condition. Further as noted previously, the spikes are designed in such a manner that they puncture the diaphragm easily without cresting any particulate material or "coring". Further, the particular design of the transfer passages is such that good flow of fluid from one container to the other is assured, one channel serving as a fluid flow channel and the other serving to vent air from one container to the other. More specifically, the leg of the transfer passage of greatest cross section at the tip extending into the container from which fluid is being transferred serves as the fluid flow channel, and its counterpart which extends more deeply into the container serves as the air vent passage. It is noted that this relationship remains the same by reason of the complementary tapers of the tip of each spike.

The cover member may be applied to the container having the mixed additive and primary solution to serve as a dust cover and prevent contamination of the exposed portion of the stopper and also as indicia means that the contents are mixed (see FIGS. 15 and 16). The outer housing is so designed that the lugs snugly embrace the skirt of the cap (FIG. 15), or the detents engage the transfer ring of the container (FIG. 16). Even though the use of the device is described in connection with primary and additive fluids, as noted previously, the additive may comprise a powder medicament.

There is illustrated in FIG. 6 a modified form of additive transfer assembly in accordance with the present invention. The structural arrangement and details of the transfer device, outer cover or housing member and detachable seal are identical to that described in the previous embodiment, and accordingly essential elements thereof are numbered the same with the subscript "a" in the drawings.

In accordance with this embodiment of the invention, the additive transfer assembly includes a sterilized overcap assembly generally designated by the numeral 70. The overcap assembly 70 includes as shown a domelike protective cover 72 having a disc-like bottom wall 74, a generally cylindrical side skirt 76 and a bulbous terminal portion 78 terminating in an outwardly directed flange 80 which confronts the flange 17*a* of the transfer device cover assembly and is secured to the underside of the seal 16*a* by suitable heat sealing.

The auxiliary closure cap 81 housed in the cover assembly has a cap portion 82 and a detachable skirt portion 84 connected by a score line 86 and a tear tab 88 for detaching the skirt when desired. The skirt has a bead 90 at its lower terminal edge adapted to engage under a cap or bead on a container to which the I.V. additive has been transferred. The cap portion also has an internal sealing bead 92 which engages the aluminum seal of the container to provide a seal therebetween. The cap portion is of a diameter so that it snugly fits in the skirt 76 of the outer lower cover assembly, the cover assembly also having an internal shoulder 94 against which the cap abuts in the manner shown.

In use, therefore, the entire assembly may be assembled and sterilized by conventional means or process and when it is desired to use the same, the seal 16*a* is simply stripped from the housing and the transfer device used in the normal manner described in connection with the embodiment of FIGS. 1–5 inclusive. It is noted that the seal 16*a* remains intact with the lower housing assembly for the auxiliary closure cap. Now after the additive has been mixed with the primary or stock solution, the seal 16*a* may be removed from the cover member 72 and the user simply applies the closure cap 81 to the container having the mixed solution by pressing it axially over the open end of the container. This closure cap will serve as indicia that the additive has been mixed with the primary or stock solution and also serves as tamperproof means protecting the contents in a sterile manner.

The additive transfer assembly illustrated in FIG. 7 is a further modification of the assembly described above, the outer cover member, transfer device and seal being identical and essential parts thereof bearing the same numeral with the letter subscript "b". The auxiliary closure cap is also identical structurally to that described in FIG. 6, and thus also bears the same reference numerals in the drawings with the subscript "b".

In the present instance, the closure cap 81*b* is housed in the main cover assembly and as illustrated, the skirt is preferably made of a diametral dimension sightly greater than the distance between confronting detents 54*b* so that when the seal 16*b* is removed, the auxiliary closure cap will be retained in place and may be carefully removed by the user. In this instance, the auxiliary closure cap 81*b* must be removed prior to use of the transfer device, care being taken not to contaminate the interior portions of the sterilized auxiliary closure cap. Of course, in some instances sterility is not a factor, and the auxiliary outer closure cap is simply used as indicia means and also as a dust cover.

There is shown in FIGS. 8–12 inclusive a further embodiment of additive transfer assembly in accordance with the present invention. This assembly is adapted for direct application to a container of an additive substance. The structural details and arrangement of the transfer device are identical to that of the previously described embodiments and thus bear the same reference numerals with the letter subscript "c".

This assembly is for use on containers wherein the stopper 100 is maintained in place by an outer cap member 102 having an outwardly directed flange 104 at its lower terminal edge. To this end the outer cover assembly which is generally designated by the numeral 110 includes an upper dome section 112 having a disclike top 114 and a generally cylindrical side wall 116, the side wall having a peripheral groove 118 adjacent its lower edge for receiving the central disc portion of the transfer device and providing a snap fit therebetween. The outer cover assembly further includes a lower section having an enlarged cylindrical sidewall 120 connected to the domelike top by a radial wall 122 and of a size to encapsulate the closure of the container for the additive medicament. The side wall terminates in a lower tear band 124 connected to the closure sidewall 120 by a circumferentially extending weakened area or score line 126. The tab 128 is provided for removing the tear skirt 124 when desired.

As noted above, this additive transfer assembly is adapted for initial application directly to the container for additive, and when the user desires to transfer the contents of the container to a primary or stock solution, the tear tab 128 is simply gripped and actuated circumferentially to release the tear band portion 124 whereby the cover member may be pushed downwardly to engage the lower spike or cannula through the diaphragm of the stopper 100 to the position shown in FIG. 10. The outer cover then may simply be moved axially upwardly to release it from the transfer device. It is noted that the frictional engagement of the spike in the stopper is such in relation to the snap fit between the central disc portion 18*c* of the transfer device and the groove so that it readily releases without pulling the transfer device out of the container. With the outer cover thus removed [see FIG. 12], the bottle may then be inverted and the upper spike inserted into the diaphragm of a stopper in the primary solution container.

There is illustrated in FIG. 13 a modified version of the assembly shown in FIGS. 9–12 inclusive and described above. In accordance with this embodiment, the outer cover assembly and container are identical and thus bear the same reference numerals with the subscript "d".

In the present instance, the transfer device which is generally designated by the numeral 150 comprises a central disclike portion 152 terminating in a bevelled edge 154 which snap fits into the groove 118*d* of the outer cover assembly. The transfer device further includes a pair of transfer cannulas or spikes 156 and 158 which project in opposite axial directions from the central disc portion 152. The outer terminal ends of the spike is tapered and the tapered terminal end of the passage 162 is staggered or spaced closer to the central disc portion than the tapered edge of the passage 160. This is also true of the lower spike as illustrated.

In the present instance, the transfer device includes at least one pair of transfer passages 160 and 162, the passages being as illustrated, of stepped configuration. More specifically the transfer passage 162 is of circular cross section and includes a passageway section 163 extending from the central disc portion 152 to the tip of the spike 156 of a greater cross sectional area than the passageway section 165 extending from the central disc portion to the tip of the spike 158. The passageway 160 includes a passageway section 167 extending from the central disc portion 152 to the tip of the spike 156 which is of smaller cross section than a passageway section 169 extending from the central disc 152 to the tip of the spike 158.

There is illustrated in FIG. 14 a further embodiment of additive transfer assembly in accordance with the present invention. This assembly is adapted for application to the additive container in a manner similar to that described in FIG. 13, and the outer cover assembly comprises a domelike upper section 200, a lower cylindrical section 202 of greater diameter, and a radial wall 204 connecting the upper and lower sections. The lower section of the housing terminates in a tear band 206 connected to the section 202 by a score line 208. The tear band and lower edge of the cylindrical portion 202 are shaped to form a circumferential pocket 210 which engages over the outwardly directed flange 212 of the closure cap 214 holding the stopper 216 in place on the container. This arrangement permits assembly of the transfer device to the container and prevents removal therefrom until the tear band 206 has been detached, thereby providing a tamperproof assembly. The lower section 202 as illustrated is formed with an internal bead 220 spaced from the radial wall 204 defining an annular pocket 222 for holding the transfer device 230 in place.

The transfer device 230 as illustrated comprises a central disc portion 232 of a diameter to provide a snap fit into the pocket 222 and which is suitably dimensioned to release the transfer device when the same is applied through the stopper of the additive container. The transfer device further includes a main cannula 240 having a passage 242 through which fluid is transferred from the additive container to another container and a smaller spike 250 serving as an air vent.

There is illustrated in FIGS. 17 and 18 a modified form of additive transfer assembly in accordance with the present invention which is generally similar in structural details and arrangement to that shown in FIGS. 9–12 inclusive. The structural details and arrangement of the transfer device and outer cover assembly are generally identical to that described in the FIGS. 9–12 inclusive embodiment, and thus principal elements thereof are designated with the same numeral with the letter subscript "f".

This embodiment is designed to be applied directly to an additive container and differs from the previously described embodiment in that the cylindrical side wall 120*f* of the outer cover assembly is provided with a plurality of axially extending circumferentially spaced score lines 150*f* extending from the upper edge thereof to the circumferential score 126*f* at the juncture of the cylindrical skirt 120*f* and the tear band 124*f*. Additionally, the lower section 120*f* is provided with an internal rib 152*f* spaced from the radial wall 122*f* providing an annular groove for supporting the transfer device in place.

This assembly greatly facilitates application of the transfer device and is particularly adapted for use on containers that are not straight sided and have an enlarged lower section of a greater diameter than the reduced neck generally of the type shown in FIGS. 17 and 18. In this instance when it is desired to transfer the contents of the container, the tear band 124*f* is simply removed and the assembly pressed downwardly whereby the spike engages in the stopper in the manner illustrated, and the axial scores 150*f* separate thereby facilitating complete insertion of the transfer device. Additionally, the scores extend through the circumferential rib 152*f* thereby releasing the center section of the transfer device from the outer cover assembly.

There is illustrated in FIGS. 19, 19*a*, 19*b* and 20 an additive transfer assembly generally similar in overall arrangement to the prior assembly shown in FIGS. 9 and 10. The present assembly includes an overcap or cover assembly for one cannula of the transfer unit, generally designated by the numeral 300, which is made of a flexible resilient material and is pierceable by the tip of the cannula when the same is inserted in the stopper in the manner illustrated in FIG. 19*b*. The transfer unit illustrated is structurally the same as those previously shown and described and includes a central portion, cannulas projecting from opposite sides of the central portion and a pair of transfer passages. The overcap 300 may be made of a soft rubber or a thin plastic material and in the form shown in FIGS. 19 and 19*a*, includes a disc-like top 302 with a partial score line 304 extending transversely of the top to facilitate penetration of the cannula therethrough and a tubular skirt 306 which depends from the top defining a pocket of circular cross section. The pocket is of a diametral dimension to snugly embrace the cannula when assembled thereto in the manner shown in FIG. 19. The function of the overcap is to prevent loss of primary or additive substances when transferring the same from one container to another. More specifically in use, the lower cannula 312 of the transfer unit 314 is inserted through the stopper 316 in the container 317 for an additive substance which may be a liquid, the outer cover assembly 318 is then removed and the additive liquid container inverted so that the upper cannula 319 faces downwardly in position to engage through the stopper 321 in the container for the primary substance. In this position, the overcap prevents flow and loss of substance from the transfer unit. The tip of the cannula 319 is then pressed into the stopper 321 simultaneously piercing the overcap to permit flow of additive to the primary container. (See FIG. 19*b*). In some instances after mixing, the solution of primary and additive substances is then transferred back to the original primary container and in this instance, the overcap serves as a pumping means to facilitate return flow.

The cover member 322 of FIG. 20 serves the same function as that described above and is likewise made of a flexible resilient material such as a soft rubber or plastic which is pierceable by the tip of the cannula of the transfer unit which is preferably made of a more rigid plastic material, for example, a polypropylene. The cover 322 is generally of tubular form and of a size to snugly embrace the cannula in the present instance for its entire length and has a rounded base portion overlying the tip of the cannula.

There is illustrated in FIGS. 21 and 22 still another embodiment of additive transfer assembly in accordance with the present invention. This assembly is generally similar in basic components to that illustrated in FIG. 8 and is designed to be directly applied to a container for an additive substance. This assembly is for use on containers of the type illustrated, generally designated by the numeral 323 and comprising an enlarged body portion 324 and a reduced neck portion 325. The neck terminates at its discharge end in an enlarged bead 326 defining a peripheral shoulder 328 against which the lower edge or flange 330 of outer retaining cap 332 engages to retain a stopper 334 in place in the neck of the container. An outer cover assembly 340 normally supports a transfer unit 341 in an unarmed position above the stopper 334 as shown in FIG. 21. The container may be made of glass or plastic, the outer cover assembly and transfer unit are preferably formed of a relatively rigid plastic material, polypropylene, and the stopper is usually a soft pierceable rubber.

The outer cover assembly 340 comprises an upper dome section 342 consisting of a disc like top 344 and a generally cylindrical side wall 346 terminating at its lower end in an internal groove 348 for receiving the central disc portion of the transfer device. As in the previously described embodiments, the central disc portion of the transfer device engages in the groove 348 by means of a snap fit and is designed to be readily releaseable therefrom when the transfer device is actuated to an armed position as discussed below. The transfer device is identical to that described previously and includes a pair of cannulas 350 and 352 projecting from opposite sides of the central disc portion 353. The outer cover member is of a stepped configuration and thus includes a lower section of generally cylindrical form 354 and of a larger diametral dimension than the dome like top 342. The lower section is connected to the dome like top section 342 by an annular radially disposed connecting wall 356. In the present instance the connecting wall is formed integrally with the dome like top and has a circumferential area of reduced cross section defining a fracturable bridge connection 351 between the top and lower sections of the outer cover assembly. The lower section 354 is secured in sealing relation to the retaining cap 332 by means of a sealing band 360, in the present instance made of a heat shrinkable plastic material.

In accordance with this embodiment of the invention, the stopper has a plug portion 362 depending into the open end of the container which is hollowed at its center portion to define a puncturable diaphragm section 364. The stopper, which is preferably made of a pierceable material, for example, soft rubber, has a tubular sleeve projection 366 surrounding the diaphragm section 364 and of a height to surround and snugly embrace the cannula 352 of the transfer device. The sleeve 366 supports the cannula 352 in a predetermined position and functions as a guide means preventing tilting of the cannula during arming of the transfer unit and thus insuring penetration of the stopper through the diaphragm section 364.

In operation therefore, when it is desired to mix additive in the container 320 with a primary substance, the dome like top is simply pushed inwardly in the manner shown in FIG. 22 to fracture the bridge connection 351 whereby the lower cannula 352 pierces the diaphragm 364 to establish communication between the transfer device and the interior of the container 323. The tear band 360 is then peeled off so that the lower section of the outer cover assembly may be removed. The dome like top section may then also be removed simply by exerting an upward pull. It is noted that the snap fit between the disc portion and the groove 348 has a weaker retaining force than the seating force holding the cannula is the stopper and therefore, the dome section readily releases from the transfer unit in the manner indicated. The outer cannula 350 is then exposed and the unit is ready for assembly to a container for the primary substance which likewise has a stopper pierceable by the cannula 350. After connecting the transfer device to the primary container, the containers are inverted to permit flow of the additive substance through the transfer unit into the primary container for mixing with the primary substance. In some instances the mixed solution is returned to the additive container 323 and this is done by simply again inverting the position of the primary and additive containers so that the solution flows by gravity to the container 323. It has been observed that on some occasions, an air lock in the transfer passages blocks initial return flow and a slight pumping action is required to initiate flow. The sleeve 366 which has been compressed to an accordian shape facilitates this pumping action to release any trapped air.

There is illustrated in FIG. 23 an assembly generally similar to that shown in FIGS. 21 and 22 except that in this instance the lower terminal section of the outer cover assembly is simply press fitted on the retaining cap 332*a* and an O-ring seal 370 is mounted in complementary annular grooves 372 and 374 on the inner side wall of the lower section of the outer cover assembly and the axial side wall of the cap 332*a*. Further, in this embodiment, the bottom terminal edge of the lower section 354 engages the body portion of the container to stabilize the assembly and prevent cocking of the transfer unit when being actuated to an armed position.

Still another embodiment of additive transfer assembly in accordance with the present invention is illustrated in FIG. 24. This assembly likewise is adapted for use on containers having a large body portion and a reduced neck on which the assembly is mounted. The basic elements of the assembly include a stopper 400 made of a soft pierceable material such as rubber, an outer cover assembly 402 and a transfer unit 404 mounted in the outer cover assembly. The transfer unit comprises a central disc portion 406 and a pair of cannulas 408 and 410 projecting from opposite sides of the disc portion, the lower cannula as illustrated being positioned above the stopper when it is unarmed. As in the previously described embodiments, the container may be made of glass or plastic and the outer cover assembly and transfer unit of a generally rigid moldable material such as polypropylene.

The outer cover assembly 402 consists of an upper dome like section 412 and a lower section 414 of a larger diametral dimension to define a step at the juncture of the upper and lower sections. The upper section has an annular groove 415 at its lower end to provide a seat releasably mounting the disc portion of the transfer unit. In the present instance the upper and lower sections are mounted for telescopic movement relative to one another when it is desired to arm the transfer unit and means is provided to normally maintain the parts in the position shown in FIG. 24. To this end, the upper section terminates at its lower end in a radially outwardly directed flange 416 which underlies a radially inwardly directed lip 418 at the upper end of the lower section. The upper dome section is supported in this position in the present instance by four circumferentially spaced tapered detents or lugs 420 having upwardly inclined faces which normally wedge the flange 416 against the lip 418 of the lower section as indicated. When it is desired to arm the assembly, the dome section 412 is pressed downwardly by the user and initially a greater resistance to movement is encountered due to the wedging action of the detents. However, when the dome has been pressed to a point below the detents, the only resistance to further telescopic movement of the dome inside the lower section is that offered by penetration of the cannula 410 through the diaphragm of the stopper 400. In the present instance the lower section is directly mounted on the stopper and includes a peripheral rib 420 which engages in a corresponding groove 422 in the stopper to provide an effective seal preventing ingress of foreign matter which may contaminate the sterile transfer unit. After arming the transfer unit, the outer cover assembly may be removed by simply pulling the upper section away from the transfer unit. Also, the frictional force between the lower cannula and stopper is greater than the seating force of the disc portion in the groove so that the outer cover assembly releases without unseating the transfer unit from the container. Note that the bottom edge of the lower section abuts the body portion of the container for stability and to insure accurate penetration of the cannula when arming the assembly. If desired, the axial height of the lower section of the assembly may be sized to provide for a slight penetration of the lower cannula 410 in the face of the stopper in the unarmed position (FIG. 24) to minimize the possibility of cocking the transfer unit when actuating the upper section 412 to arm the assembly.

In the present instance the configuration of the stopper eliminates the need for a retaining cap. To this end the stopper, as illustrated, has a plug portion 424 which depends into the open discharge end of the container and a continuous peripheral skirt 426 depending from the top and radially spaced therefrom to define a pocket 428 which engages over the finish or bead 430 on the container. The skirt 426 has at its lower and a return lip 432 which engages under the bead to lock the stopper in place. Note that the return bead has a downwardly and outwardly tapered face 434 which provides a camming action flexing the skirt outwardly when it is initially applied to the container. (See FIG. 25). This permits assembly of the stopper to the container by automatic capping equipment. Alternatively, the stopper may be assembled to the container by first turning the skirt 426 upwardly to the position shown in FIG. 26, inserting the plug portion into the open end of the container and then pivoting the skirt downwardly in the manner indicated by the arrows in FIG. 26 to the seated broken line position illustrated.

Thus, while the invention has been described with particular reference to specific embodiments thereof, it will be understood that it may be embodied in a variety of forms diverse from those specifically shown and described, without departing from the spirit and scope of the invention as defined by the appended claims.

What is claimed is:

1. A transfer device for use in mixing substances in different containers comprising a central body portion and a pair of cannulas projecting from opposite sides of said central body portion, each of said cannulas having an outer tip portion, means defining at least one pair of transfer passages extending through said cannulas and extending the full length of said cannulas from the tip portion of one cannula to the tip portion of the other cannula, the cross sectional area of one of said transfer passages adjacent the tip of one cannula being greater than the cross sectional area of said one transfer passage adjacent the tip of said other cannula, each of the transfer passages being of circular cross section, one of said transfer passages converging toward the tip of one cannula and the other transfer passage converging toward the tip of the other cannula.

2. A transfer device as claimed in claim 1 wherein the tip of each cannula is tapered in relation to the central axis thereof at an angle of between 45° and 60°.

3. A transfer device as claimed in claim 1 wherein the central body portion is of a disc-like configuration.

4. A transfer device as claimed in claim 1 wherein the tip of each cannula is tapered relative to the central axis thereof and the face of the tapered tip is arcuate.

5. A transfer device as claimed in claim 1 wherein the cannulas are coated with a lubricant to facilitate insertion and removal of the stopper.

6. A transfer device as claimed in claim 1 wherein the tip of each cannula is tapered in relation to the central axis thereof, and each tip has a contoured arcuate piercing face.

7. A transfer device as claimed in claim 1 wherein each of said cannulas is of an enlarged cross section adjacent said central body portion to define an annular shoulder on each cannula spaced outwardly from said body portion and inwardly from the tip portion of said cannulas.

8. The combination including a transfer device for use in mixing substances in different containers; one of said containers having a closure member in the discharge opening therein, said transfer device comprising a central body portion and a pair of aligned cannulas projecting from opposite sides of said central body portion, each terminating at its outer end in a tip portion, means defining at least one transfer passage extending through said cannulas, an outer cover member including means for supporting the transfer device therein in spaced relation from the closure member, said outer cover member having an opening and a detachable closure member overlying said opening, means for supporting said transfer device in said outer cover member comprising at least a pair of diametrically opposed spaced lugs on the interior and having inner face portions cooperable with said central body portion to retain said transfer device in place in the outer cover member, said outer cover member having a lower section and including at least a pair of diametrically opposed detents on the inner wall thereof having axial face portions spaced apart a distance greater than the spacing of said lugs.

9. The combination as claimed in claim 8 wherein said cover member is heat sealed at its outer periphery to an outwardly directed flange adjacent the opening in said outer cover member.

10. The combination as claimed in claim 8 wherein the inner face portion of at least two adjacent lugs taper inwardly at a small angle of approximately 2°.

11. The combination as claimed in claim 8 wherein one of said containers includes a stopper having a diaphragm and wherein the wall of the stopper below the diaphragm tapers outwardly.

12. The combination as claimed in claim 8 including an overcap assembly consisting of a protective cover secured to said closure member and an auxiliary closure cap mounted in said protective cover member.

13. The combination as claimed in claim 8 wherein said central body portion is of generally circular shape and wherein the confronting face portions of said lugs are spaced apart a distance less than the diameter of said disc portion to provide a friction fit therebetween.

14. The combination including a transfer device for use in mixing substances in different containers comprises a central body portion and a pair of aligned cannulas projecting from opposite sides of-said central body portion, means defining at least one transfer passage extending through said cannulas, an outer cover member including means for supporting the transfer device therein, said outer cover member including means for detachably securing it directly to the container, the portion of the outer cover member above said detachable means being provided with a plurality of axially extending score lines which upon removal of said detachable means and actuation of said cover member relative to said container to insert said transfer device causes separation along said axial score lines.

15. The combination including a transfer device for use in mixing substances in different containers comprising a central body portion and a pair of aligned cannulas projecting from opposite sides of said central body portion, means defining at least one pair of transfer passages extending through said cannulas, one of said transfer passages being of a greater cross sectional area at the tip of one of said cannulas than the cross sectional area of the other transfer passage, said one transfer passage having a smaller cross section than the other transfer passage at the tip of the other cannula, an outer cover member including means for supporting the transfer device therein and means in the form of a detachable tear band for detachably securing said cover member to said container, the portion of said outer cover member above said tear band being provided with a plurality of axially extending score lines which upon removal of the tear band and actuation of said cover member relative to said container to insert said transfer device causes separation along said axial score lines.

16. The combination including a transfer device for use in mixing substances in different containers comprising a central body portion and a pair of aligned cannulas projecting from opposite sides of said central body portion, means defining at least one pair of transfer passages extending through said cannulas, one of said transfer passages being a greater cross sectional area at the tip of one of said cannulas than the cross sectional area of the other transfer passage, said one transfer passage having a smaller cross section than the other transfer passage at the tip of the other cannula, said container having mounted in the opening thereof a puncturable diaphragm and an outer cover member including means for supporting said transfer device so that one of the tip portions overlies the puncturable diaphragm whereby upon actuation of said cover member axially towards said container, said tip portion engages through said diaphragm.

17. The combination including a transfer device for use in mixing substances in different containers comprising a central body portion and a pair of aligned cannulas projecting from opposite sides of said central body portion, means defining at least one transfer passage extending through said cannulas, an outer cover member including means for supporting the transfer device therein and means for detachably securing said cover member to said container, the portion of said outer cover member above said detachable means being provided with a plurality of axially extending score lines which upon removal of the detachable means and actuation of said cover member relative to said container to insert said transfer device causes separation along said axial score lines.

18. The combination including a transfer device for use in mixing substances in different containers comprising a central body portion and a pair of aligned cannulas projecting from opposite sides of said central body portion, means defining at least one pair of transfer passages extending through said cannulas, one of said transfer passages being of a greater cross sectional area at the tip of one of said cannulas than the cross sectional area of the other transfer passages, said one transfer passages having a smaller cross section than the other transfer passage at the tip of the other cannula, an outer cover member including means for supporting the transfer device therein, said outer cover member including means for detachably securing it directly to the container.

19. The combination as claimed in claim 18 wherein said detachable means connecting said outer cover member includes a detachable tear band connected to the housing by a scored area.

20. The combination as claimed in claim 19 wherein the portion of the outer cover member above said tear band is provided with a plurality of axially extending score lines which upon removal of said tear band and actuation of said cover member relative to said container to insert said transfer device causes separation along said axial score lines.

21. The combination including a transfer device for use in mixing substances in different containers comprising a central body portion and a pair of aligned cannulas projecting from opposite sides of said central body portion, means defining at least one pair of transfer passages extending through said cannulas, one of said transfer passages being of a greater cross sectional area at the tip of one of said cannulas than the cross sectional area of the other transfer passages, said one transfer passage having a smaller cross section than the other transfer passage at the tip of the other cannula, an outer cover member including means for supporting the transfer device therein, said outer cover member including means for detachably securing it directly to the container, said detachable means connecting said outer cover member including a detachable tear band connected to the housing by a scored area.

22. A transfer device for use in mixing substances in different containers comprising a central body portion and a pair of cannulas projecting from opposite sides of said central body portion, each of said cannulas having an outer tip portion, means defining at least one pair of transfer passages extending through said cannulas and extending the full length of said cannulas from the tip portion of one cannula to the tip portion of said other cannula, the cross sectional area of one of said transfer passages adjacent the tip of one cannula being greater than the cross sectional area of said one transfer passage adjacent the tip of said other cannula, the cross sectional area of said other transfer passage adjacent the tip of said other cannula being greater than the cross sectional area of said other passage adjacent the tip of said one cannula, the cross sectional area of said one transfer passage adjacent the tip of said one cannula being greater than the cross sectional area of said other transfer passage at the tip of said one cannula and the cross sectional area of said other transfer passage adjacent the tip of said other cannula being greater than the cross sectional area of the one transfer passage adjacent the tip of said other cannula.

23. The combination including a transfer device for use in mixing substances in different containers comprising a body portion and a pair of cannulas projecting from opposite sides of said body portion, means defining at least one transfer passage extending through said cannulas, an outer cover member comprising first and second sections, means detachably securing said first section of said cover member to one of said containers, means releasably connecting said first and second sections, means mounting said transfer device in said second section, a stopper assembly comprising a pierceable diaphragm portion mounted in the discharge opening in said one container one of said cannulas being aligned with said diaphragm, said second section adapted for telescoping actuation relative to said first section upon release of said connecting means whereby said one cannula punctures said diaphragm to establish communication with the interior of the container.

24. The combination as claimed in claim 23 including means for sealing said first section to said one container.

25. The combination as claimed in claim 24 wherein said sealing means comprises a complementary rib and groove means on the first section and said stopper assembly.

26. The combination as claimed in claim 24 wherein said sealing means comprises an O-ring mounted between said first section and said stopper assembly.

27. The combination as claimed in claim 23 wherein said connecting means comprises a fracturable bridge connection.

28. The combination as claimed in claim 23 wherein said connecting means for said sections comprises at least one detent mounted on the interior wall of said first section and a radial lip on the second section engageable with said detent to normally retain said transfer device in an unarmed position, said lip disengageable from said detent to permit telescopic movement of said sections to arm said transfer device.

29. The combination as claimed in claim 23 wherein said stopper includes an elongated sleeve projecting upwardly from stopper snugly embracing one of the cannulas and serving as a guide means therefor.

30. A transfer device for use in mixing substances in different containers comprising a central body portion and a pair of cannulas projecting from opposite sides of said central body portion, each of said cannulas having an outer tip portion, means defining at least one pair of transfer passages extending through said cannulas and extending the full length of said cannulas from the tip portion of one cannula to the tip portion of the other cannula, the cross sectional area of one of said transfer passages adjacent the tip of one cannula being greater than the cross sectional area of said one transfer passage adjacent the tip of said other cannula, one of said transfer passages converging toward the tip of one cannula and the other transfer passage converging toward the tip of the other cannula.

31. A transfer device for use in mixing substances in different containers comprising a central body portion and a pair of cannulas projecting from opposite sides of said central body portion, each of said cannulas having an outer tip portion, means defining at least one pair of transfer passages extending through said cannulas and extending the full length of said cannulas from the tip portion of one cannula to the tip portion of the other cannula, one of said transfer passages being tapered relative to its central axis and converging toward the tip portion of one cannula and the other transfer passage being tapered relative to its central axis and converging toward the tip portion of the other cannula.

32. A transfer device for use in mixing substances in different containers comprising a central body portion and a pair of cannulas projecting from opposite sides of said central body portion, each of said cannulas having an outer tip portion, means defining at least one pair of transfer passages extending through said cannulas and extending the full length of said cannulas from the tip portion of one cannula to the tip portion of the other cannula, each of said passages being of a stepped configuration, one of said transfer passages including a first passageway section extending from the tip of one cannula and being of greater cross section than a second passageway section extending from the tip of the other cannula, the other transfer passage including a third passageway section extending from the tip of one cannula and being of a smaller cross section than a fourth passageway extending from the tip of the other cannula.

* * * * *

UNITED STATES PATENT AND TRADEMARK OFFICE

CERTIFICATE OF CORRECTION

PATENT NO. : 4,296,786

DATED : October 27, 1981

INVENTOR(S) : Dominic J. Brignola

It is certified that error appears in the above-identified patent and that said Letters Patent are hereby corrected as shown below:

Column 1, line 44; "control" should be --central--
Column 2, line 19; "Fig. 5b" should be --Fig. 5a--

Column 4, line 22; "30" should be --30°--
Column 7, line 25; "sightly" should be --slightly--
Column 11, line 33; "is" should be --in--

Signed and Sealed this

*Twenty-fourth* Day of *August 1982*

[SEAL]

*Attest:*

GERALD J. MOSSINGHOFF

*Attesting Officer*

*Commissioner of Patents and Trademarks*